United States Patent [19]

Ohta

[11] Patent Number: 4,460,066

[45] Date of Patent: Jul. 17, 1984

[54] CRIME PREVENTION APPARATUS FOR ELEVATORS

[75] Inventor: Kazutoshi Ohta, Nagoya, Japan

[73] Assignee: Mitsubishi Denki Kabushiki Kaisha, Tokyo, Japan

[21] Appl. No.: 462,703

[22] Filed: Jan. 31, 1983

[30] Foreign Application Priority Data

Feb. 8, 1982 [JP] Japan ..... 57-18348
Feb. 8, 1982 [JP] Japan ..... 57-18349

[51] Int. Cl.[3] ..... B66B 13/00; B66B 5/00

[52] U.S. Cl. ..... 187/29 R; 340/19 R; 340/20; 340/21; 340/556; 340/666; 367/92; 367/93

[58] Field of Search ..... 187/29 R, 30, 31, 47, 187/48, 49, 50, 52 R, DIG. 1; 340/19, 20, 21, 666, 555, 556; 367/92, 93, 94; 318/600, 601, 603, 640, 646

[56] References Cited

U.S. PATENT DOCUMENTS

| | | | |
|---|---|---|---|
| 2,968,366 | 1/1961 | Drexler | 187/29 R |
| 3,367,450 | 2/1968 | Lester et al. | 367/93 X |
| 3,750,158 | 7/1973 | Anastassakis | 340/666 X |
| 3,967,702 | 7/1976 | Iwaska et al. | 340/19 R X |
| 4,009,389 | 2/1977 | Lindholm | 340/555 X |
| 4,023,135 | 5/1977 | Hanmura et al. | 367/93 |
| 4,023,151 | 5/1977 | Markham | 340/666 X |
| 4,029,176 | 6/1977 | Mills | 187/52 R |
| 4,064,509 | 12/1977 | Stockdale | 340/556 |
| 4,112,419 | 9/1978 | Kinoshita et al. | 340/19 R X |

FOREIGN PATENT DOCUMENTS

| | | | |
|---|---|---|---|
| 30-334867 | 1/1955 | Japan . | |
| 34-389515 | 3/1959 | Japan . | |
| 52-33237 | 3/1977 | Japan | 187/29 R |
| 2088107 | 6/1982 | United Kingdom | 340/566 |

*Primary Examiner*—G. Z. Rubinson
*Assistant Examiner*—Paul Shik Luen Ip
*Attorney, Agent, or Firm*—Leydig, Voit, Osann, Mayer and Holt, Ltd.

[57] ABSTRACT

A crime prevention apparatus for controlling the operation of an elevator which comprises a night detector for detecting night, a passenger detector for detecting the presence of only one adult passenger in an elevator cage and a start instructing unit for enabling the operation of the cage only when the passenger and the night detectors are operated, thereby allowing the operation of the cage only when one adult passenger rides in the cage during the night and thereby preventing most crimes from occuring in the cage during the night.

12 Claims, 16 Drawing Figures

CRIME PREVENTION APPARATUS FOR ELEVATORS

BACKGROUND OF THE INVENTION

The present invention relates to an improvement in an apparatus for preventing a crime in an elevator cage.

Since an elevator cage basically becomes a locked room when the elevator door closes, crimes such as rude behavior to a passenger (particularly to female passengers) frequently occur in the locked elevator cage. In order to rescue a passenger in the cage from these crimes, various proposals have been disclosed. However, according to the present inventor's analysis of conventional crime examples, the following results could be observed:

(a) Even if a device for detecting the loud voice of a passenger in the cage is provided, only approx. 18% of assaulted passengers could be rescued.

(b) Even if the crime is detected by a voice recognition, only approx. 23% of the assaulted passengers are rescued due to the assaulted passenger's mouth often being blocked by the assailant.

(c) Even if the quick motion of the passenger's hand in the cage is detected, only approx. 35% of the assaulted passengers are rescued.

(d) Approx. 50% of the crimes could be prevented if the elevator door were closed immediately after only one passenger enters the elevator cage. This, however, remarkably reduces the operating efficiency of the elevator due to only one passenger being able to utilize the cage especially during the daytime.

Since passenger's minds cannot be read, a fool proof method for the prevention of crimes in elevator cages has not yet be discovered.

SUMMARY OF THE INVENTION

The present invention has been made to eliminate the foregoing drawbacks and disadvantages, and has for its object to provide a crime prevention apparatus for controlling the operation of an elevator in which an elevator cage can be operated only when one adult passenger utilizes the cage during the night, thereby preventing most crimes in the cage.

In order to achieve this and other objects of the invention, there is provided a crime prevention apparatus for controlling an elevator which comprises a night detector for detecting that it is night, a passenger detector for detecting the presence of only one adult passenger in the elevator cage and a start instructing unit for enabling the cage to operate only when the passenger detector and the night detector are operated.

Another object of the present invention is to provide a crime prevention apparatus for controlling an elevator in which a detector indicates the presence of only one adult person and the cage can be operated only when the adult passenger rises in the cage, thereby preventing most crimes in the cage.

In order to perform this and other objects of the invention, there is provided a crime prevention apparatus for controlling an elevator in which the elevator cage can be operated only when an adult passenger rises in the cage and a crime prevention instructing unit is operated at an elevator hall or in the cage. Therefore, when the passenger feels endangered, he can avoid rising with another or other passengers in the cage, thereby preventing a potential assault in the cage.

BRIEF DESCRIPTION OF THE DRAWINGS

In the drawings, the same symbols indicate the same or corresponding parts.

DESCRIPTION OF THE PREFERRED EMBODIMENTS

Figure 1:
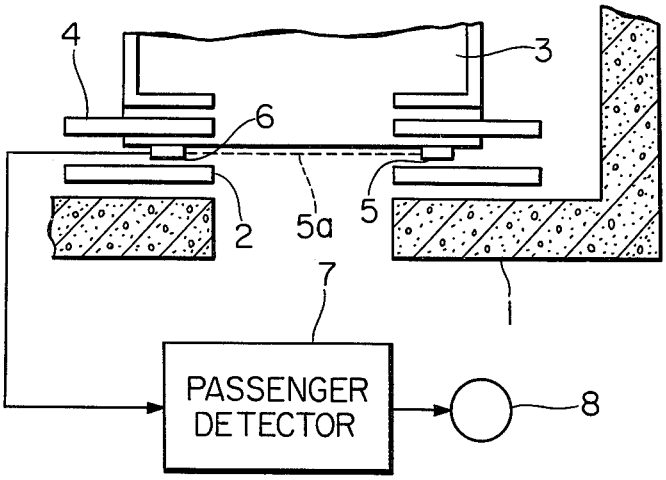
FIG. 1 is a plan sectional view of an elevator hall and an elevator cage showing a first embodiment of a crime prevention apparatus for controlling an elevator according to the invention.

A preferred embodiment of the invention will be described with reference to FIGS. 1 and 2.

In the drawings, reference numeral 1 designates the wall of an elevator hall, numeral 2 designates a hall door which opens and closes its passenger entrance, numeral 3 designates an elevator cage, numeral 4 designates a cage door which opens and closes the cage entrance by the operation of machine (not shown) installed in the case 3, numeral 5 designates a light projector for projecting a light ray which cross the cage entrance and is provided on the cage 3, numeral 6 designates a photodetector which detects the light ray 5*a* and which generates an output each time the light ray 5*a* is interrupted, numeral 7 designates a passenger detector having a counter which is connected to the photodetector 6 and which produces an output when counting two inputs and which automatically resets after a preset period of time, numeral 8 designates an output relay which is energized when the detector 7 produces an output and which has a normally-closed contact 8*a*, numeral 9 designates a calling detecting relay contact which closes when a hall calling of a hall button or a cage calling of a designation button in the cage 3 is registered, numeral 10*a* designates a night detector contact which is controlled by a watch unit and which is closed during the daytime and opened during the night, numeral 10*b* designates a night detector contact which similarly opens during the daytime and closes during the night, numeral 11 designates a start instructing relay which generates instructions for driving the cage door 4 and starting the cage 3 when the relay is energized, and the symbols (+) and (−) a D.C. power supply.

The operation of the above-described embodiment of the invention will be described herebelow with reference being made to FIGS. 1 and 2.

The night detector contact 10*a* is closed during the daytime. When a calling is generated and the calling detecting relay contact 9 is closed, the start instructing relay 11 is energized by the D.C. power supply via contacts 9, 10*a*. When the cage door 4 and the hall door 2 are closed, the cage 3 is immediately started. When the doors 4 and 2 are both opened, the door 4 is driven, and the door 2 is cooperatively driven. When the doors 4 and 2 are both closed, the cage 3 is started.

The night detector contact 10*a* is opened during the night, and the night detector contact 10*b* is closed. In this case, the doors 4 and 2 remain open. This condition is termed "door opening standby". Since this condition itself is widely known, a detailed description will be omitted. When a passenger rides in the cage 3, the light ray 5*a* is interrupted by the passenger. As a result, the photodetector 6 generates an output, and the passenger detector 7 counts the output. Since the detector 7 does not however generates an output, the output relay 8 is not energized, and the contact 8*a* remains closed. Then, when the riding passenger in the cage registers the cage calling by depressing a destination button (not shown), the relay contact 9 is closed, and the start instructing relay 11 is energized by the D.C. power supply via contacts 9, 10*b*, 8*a*, thereby causing the cage 3 to be started.

Assuming that, a passenger enters the cage, when a second passenger already rides the cage, the photodetector 6 will produce two outputs. Consequently, the detector 7 generates an output, the relay 8 is energized, and the contact 8*a* is caused to open. Therefore, even if the passenger registers the cage calling and the contact 9 is caused to close, the relay 11 is not energized, both the doors 4 and 2 are not closed, and the cage 3 does not move. Subsequently, when the detector 7 is automatically reset, the relay 8 is deenergized, and the contact 8*a* is closed. As a result, the cage 3 becomes operable.

As described above, the operation of the elevator cage in which two passengers ride simultaneously can be prevented thereby eliminating the possibility of a crime occuring in the cage 3. Further, the cage keeps the "door opening standby", and a passenger who feels endangered can accordingly go out of the cage 3 at any time. Since there are less people entering and exiting a building during the night and particularly at midnight, even though the cage is operated with only one passenger, it does not reduce the operating efficiency of the elevator cage. In this manner, when the night operation is set from 17:00 to 5:00, approx. 80% of the crimes in elevator cages can be prevented, and when the night operation is set from 23:00 to 5:00, approx. 53% of the crimes can be prevented.

Figure 2:
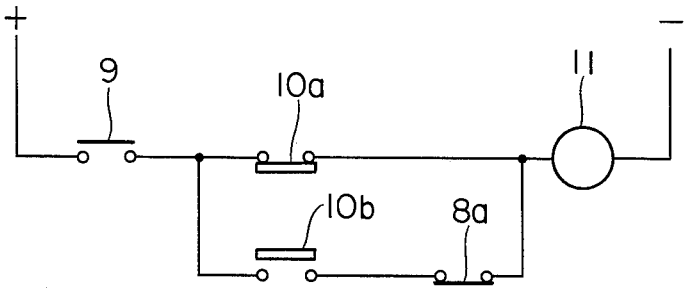
FIG. 2 is a circuit diagram showing a control system utilized in FIG. 1.
Figure 2B:
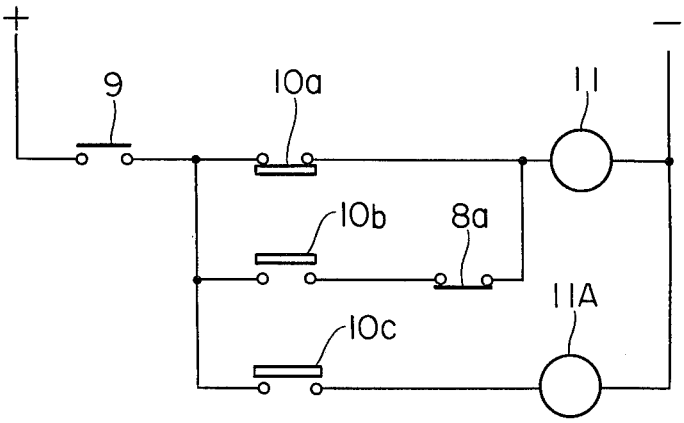
FIG. 2B is a circuit diagram showing another control system.

As indicated in FIG. 2B, a contact 10*c* which operates similarly to the contact 10*b*, and a relay 11A for energizing a display lamp provided in the cage 3 are provided and a notice "note that the cage will start only when one passenger rides in the cage during the night" is activated to inform the passengers in the elevator cage.

In the above-described embodiment, normal operation of the elevator cage is automatically reset after a predetermined period of time. However, the arrangement may be so designed that a lockable switch is provided in the elevator hall or in the cage 3, wherein the cage is manually reset by the operation of the switch or by a magnetic card or by a keyboard and a decoder for the input thereof is provided and the cage is reset by the output signal therefrom. Further, a destination button in the cage or an elevator hall button may be used instead of the keyboard. In addition, a time limiting reset and a manual reset may be incorporated.

Figure 3:
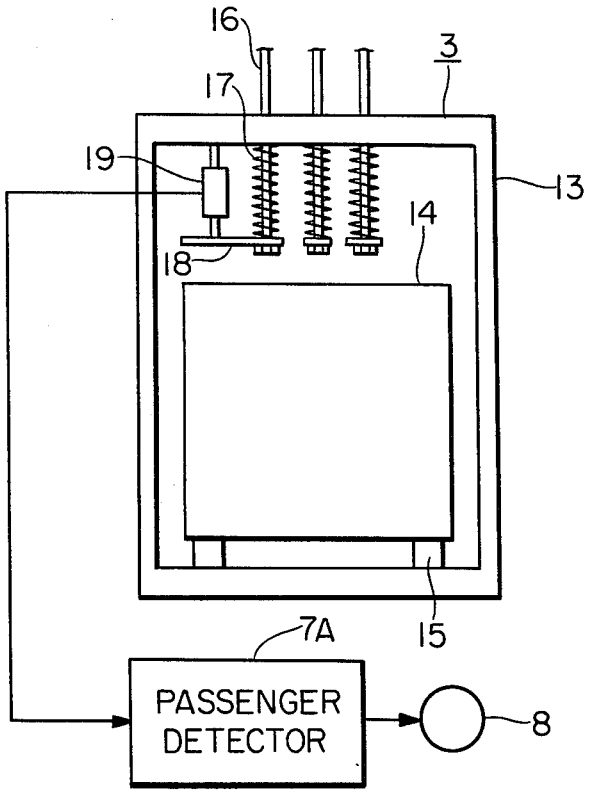
FIG. 3 is a front view of the cage section showing a second embodiment of the apparatus according to the invention.
Figure 4:
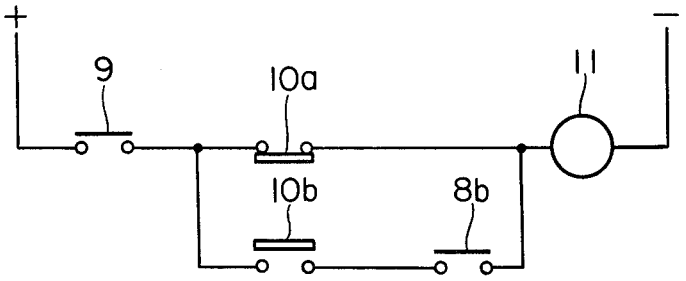
FIG. 4 is a circuit diagram showing a control system utilized in FIG. 3.
Figure 5:
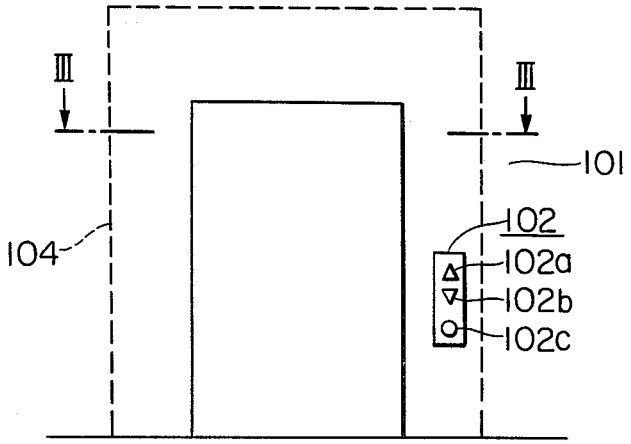
FIG. 5 is a front view of an elevator hall (in an elevator door open state) showing a third embodiment of a crime prevention apparatus according to the invention.
Figure 6:
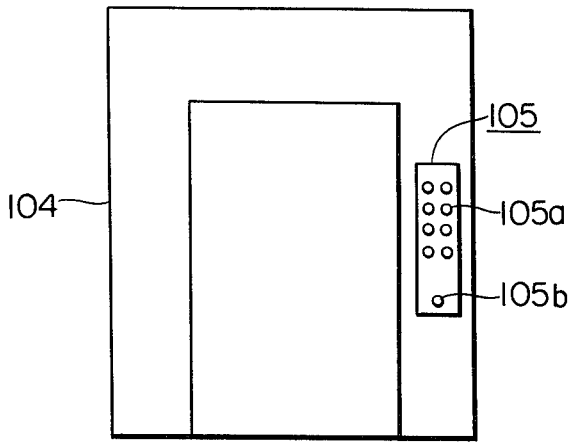
FIG. 6 is a front view of the cage entrance as seen from the interior of the cage of FIG. 5.
Figure 7:
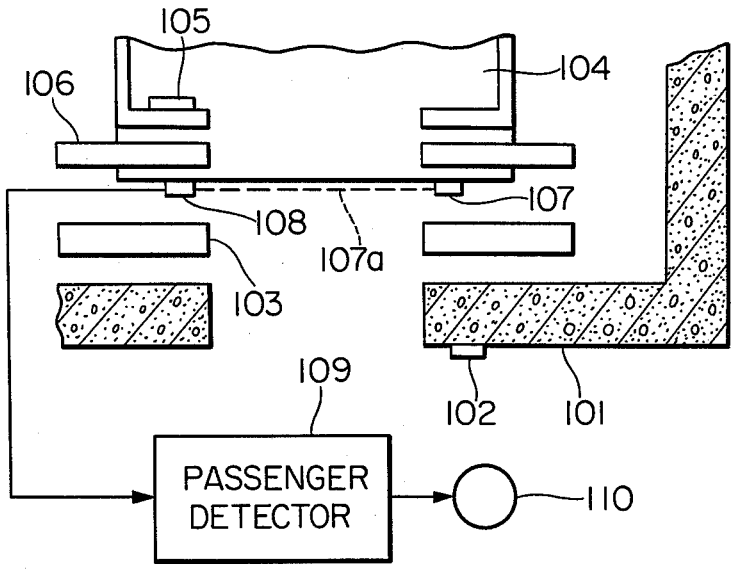
FIG. 7 is a sectional view taken along the line III—III in FIG. 5.
Figure 8:
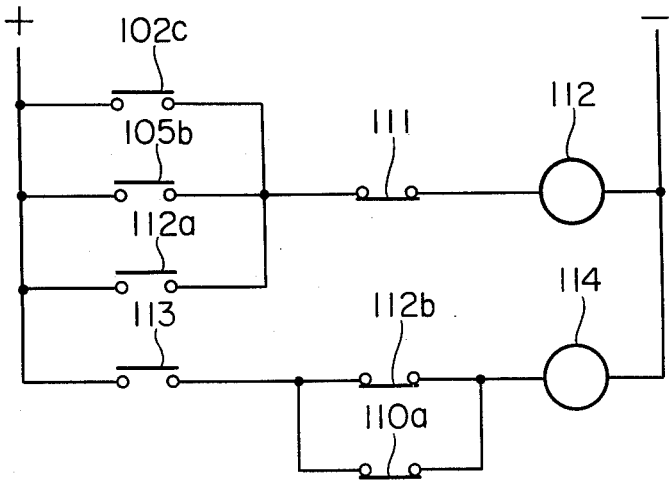
FIG. 8 is a circuit diagram showing a control system utilized in FIG. 7.

FIGS. 3 and 4 illustrates another embodiment of the invention in which only the components which are not similar to those in FIG. 2 are shown.

In FIGS. 3 and 4, reference numeral 7A designates a passenger detector which produces an output when less than two adult passengers are detected by the output of a load detector 19 to be described later, numeral 8*b* designates a normally-open contact of the output relay 8, numeral 13 designates a cage frame which is formed in a window frame shape, numeral 14 designates a cage chamber which is supported by the frame 13 via a vibration-proof rubber 15, numeral 16 designates clamping fittings which support the frame 13 via pushing springs 17 through an inner lateral member above the frame 13 and which are coupled at the upper ends thereof to main cables (not shown), numeral 18 designates a supporting plate which is fixed to the lower ends of the fittings 16 and numeral 19 designates a load detector which is composed of a differential transformer provided between the frame 13 and the plate 18 having a dial gauge, etc. for measuring the quantity of deflection of the spring 17 and producing an output corresponding to the quantity of the deflection of the spring.

The detector 7A determines the number of passengers in the cage chamber 14 according to the quantity of deflection of the springs 17 and produces an output when detecting that less than two adult passengers are in the cage chamber 14. The output relay 8 is energized by said output, and the contact 8*b* is caused to close thereby allowing the cage 3 to operate. When the detector 7A detects more than two passengers, the detector 7A does not produce an output, and the contact 8*b* remains open. As a result, the cage 3 is not allowed to start.

It is assumed that, for the case where the loading capacity of the cage chamber 14 is 1000 kg., the detector 7A detects whether or not the passenger weight is less than a total weight of 90 kg or 40 kg for female passenger's and 50 kg for light male passenger's. Then, the ratio of the minimum measuring weight to the loading capacity becomes $90/1000=0.09=9\%$. As a result, the detector 7a can detect the presence of less than two passengers.

In the above-described embodiment, the detector 7A can similarly detect the number of passengers in the cage chamber 14 even if the detector measures the quantity of deflection of the rubber 15 instead of measuring the quantity of deflection of the springs 17.

As described above, in accordance with the embodiment of the present invention, the operation of the elevator cage is controlled only when an adult passenger rides in the elevator cage during the night. Accordingly, most of the crimes in the elevator cage during the night can be prevented without deteriorating the operating efficiency of the elevator during the daytime.

A third embodiment of the invention will be described herebelow with reference to FIGS. 5 to 8.

In FIGS. 5 to 8, reference numeral 101 designates a wall of an elevator hall, numeral 102 designates round buttons installed on the wall 101 of the hall, numeral 102*a* designates an upward button, numeral 102*b* designates a downward button, numeral 102*c* designates a crime prevention instructing unit which is composed of a button, numeral 103 designates a hall door which opens and closes a hall entrance, numeral 104 designates an elevator cage, numeral 105 designates an in-cage control panel which is installed in the cage 104, numeral 105*a* designates a destination button, numeral 105*b* designates a crime prevention instructing unit which is composed of a button, numeral 106 designates a cage door which opens and closes a cage entrance by a driving machine (not shown) which is installed in the cage 104, numeral 107 designates a light projector which projects a light ray 107*a* and is provided in the cage 104 which crosses the cage entrance, numeral 108 designates a photodetector which receives the light ray 107*a* and which produces an output every time the light ray 107*a* is interrupted, numeral 109 designates a passenger detector which comprises a counter and which is connected to the photodetector 108, wherein said counter counts the interruptions in the light ray 107*a* produces an output when the counter counts two inputs and which is automatically reset after a predetermined period of time, numeral 110 designates an output relay which is energized when the detector 109 produces an output, numeral 110*a* designates a normally-closed contact, numeral 111 designates a cage calling running relay contact which opens only when the cage 104 is running with a cage calling and which is closed except when the cage 104 is running, numeral 112 designates a crime prevention instructing relay having a normally-open contact 112*a* and a normally-closed relay 112*b*, numeral 113 designates a calling detecting relay contact which closes when a hall calling of upward or downward button 102*a* or 102*b* of the hall button 102 or a cage calling of the destination button 105*a* of the control panel 105 is registered, numeral 114 designates a start instructing relay which produces an instruction for driving the cage door 106 and starting the cage 104 when the relay is energized, by the D.C. power supply.

The operation of the above-described embodiment of the invention will be described with reference to FIGS. 5 to 8.

When the crime prevention instructing unit 102*c* and 105*b* are not operated, the crime prevention instructing relay 112 is deenergized, and its contact 112*b* is closed. When a call is issued from an other floor and the calling detecting relay contact 113 is closed, the start instructing relay 114 is energized by the D.C. power supply via contacts 113, 112*b*. Thus, the cage 104 is started. In the case where a cage calling is registered with the destination button 105*a* of the control panel 105 when the cage 104 is stopped at a given floor and the doors 106 and 103 are open, the relay contact 113 is similarly closed. As a result, the door 106 is driven, the door 103 which is interlocked with the door 106 is also driven, and when both the doors 106 and 103 are closed, the cage 104 is started.

Assuming that the cage 104 is located at another storey, and a passenger calls for the cage 104 by depressing the upward or downward button 102*a* or 102*b* of the button 102, and a suspiciously acting person exists in the vicinity of the hall at this time, when the passenger who feels endangered operates the crime preventing instructing unit 102*c*, the relay 112 is energized, the contact 112*a* is closed and is self-held. Simultaneously, the contact 112*b* is opened. When the cage 103 is stopped at this storey in response to the calling and the doors 106 and 103 are opened, both the doors 106 and 103 normally start closing after a predetermined period of time (e.g., 4 seconds). However, when the relay 112 is energized, both the doors 106 and 103 remain open.

Assuming that a passenger is ridding in the cage 104, the light ray 107*a* would have been interrupted by said passenger. Accordingly, the photodetector 103 produces an output, and the detector 109 counts the output. Since the detector 109 does not however produce an output, the relay 110 is not energized, and the contact 110*a* remains closed. Accordingly, when the riding passenger registers a cage calling by the button 105*a*, the relay contact 113 is closed, and the relay 114 is energized by the D.C. voltage via contacts 113, 110, and the cage 104 is started. When the cage 104 is thus started, the relay contact 111 is opened. Therefore, the relay 112 is deenergized, and the contact 112*a* is opened.

Assuming that after a passenger has ridden in the cage, a second passenger subsequently enters the cage, the photodetector 108 produces two outputs, and the detector 109 produces an output. Then, the relay 110 is energized, and the contact 110*a* is opened. As a result, even if the passenger registers a cage calling so that the relay contact 113 is closed, the relay 114 is not energized, both the doors 106 and 103 are not closed, and the cage 104 is not started. When the detector 109 is then automatically reset, the relay 110 is deenergized, the contact 110*a* is closed, and the cage 104 becomes reusable.

In this manner, the operation of the cage in which two passengers ride simultaneously can be avoided, and a crime in the cage 104 can be prevented. Since the cage remains in a door opening standby state, a passenger who feels endangered can walk out of the cage 104 at any time.

A similar operation to the above operation can be performed even when the crime prevention instructing unit 105*b* is operated in the cage 104.

In the above-described embodiment, the return to the normal operation of the elevator cage is automatically returned after a predetermined period of time. However, the arrangement may be so designed that a lockable switch is provided in the elevator hall or in the cage 104, wherein the cage is manually reset by the operation of the switch or by a magnetic card or by a keyboard and a decoder for the input thereof is provided and the cage is reset by the output signal therefrom. Further, a destination button 105*a* in the cage or an elevator hall button 102 may be used instead of the keyboard. In addition, a time limiting reset and a manual reset may be incorporated.

Figure 9:
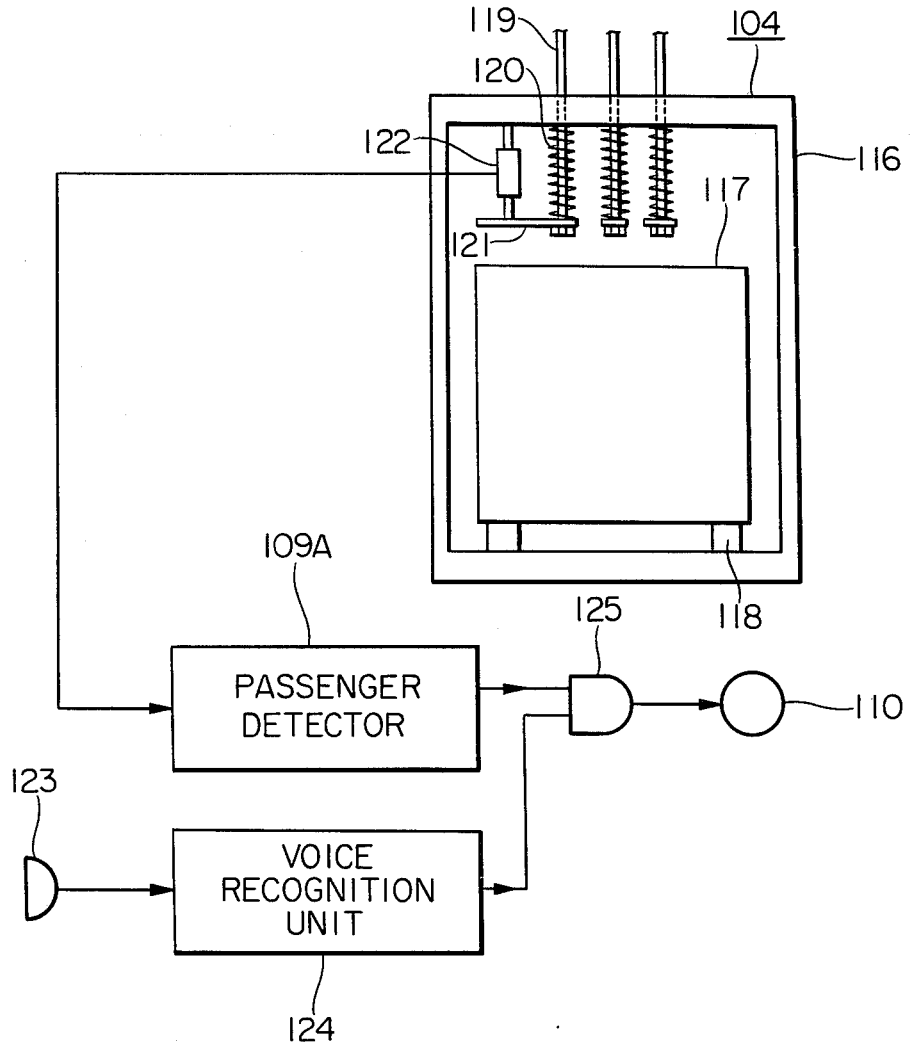
FIG. 9 is a front view of the cage section showing a fourth embodiment of the apparatus according to the invention.
Figure 10:
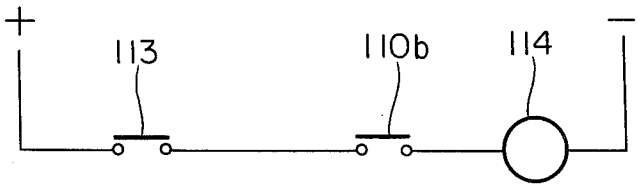
FIG. 10 is a circuit diagram of a control system utilized in FIG. 9.

A fourth embodiment of the invention is illustrated in FIGS. 9 and 10.

In FIGS. 9 and 10, reference numeral 109A designates a passenger detector which produces a high output "H" when less than two adult passengers are detected according to the output of a load detector 122 (to be described later), numeral 110*b* designates a normally open contact of the output relay 110, numeral 116 designates a cage frame which is formed in a window frame shape, numeral 117 designates a cage chamber which is supported in the frame 116 by a vibration-proof rubber 118, numeral 119 designates clamping fittings which support the frame 116 via pushing springs 120 through an upper lateral member above the frame 116 and which are coupled at the upper ends thereof to main cables (not shown), numeral 121 designates a supporting plate which is fixed to the lower ends of the fittings 119, numeral 122 designates a load detector which is composed of a differential transformer, a dial gauge, etc., provided between frame 116 and the plate 121 for measuring the deflections of the springs 120 and producing an output corresponding to the measured deflections of the spring, numeral 123 designates a microphone which is installed in the hall and which generates a voice signal, numeral 124 designates a voice recognition unit which produces an high output "H" when a voice signal of "one passenger" is input thereto, and numeral 125 designates and AND gate.

When a passenger sounds a voice of "one passenger" to the microphone 123, the output of the voice recognition unit 124 becomes "H". On the other hand, the number of passengers riding in the cage chamber 117 is detected by the quantity of the deflection of the pushing springs 120, and when less than two adult passengers ride in the cage chamber, the output of the detector 109A becomes "H". Then, the output of the AND gate 125 becomes "H", the output relay 110 is energized, and the contact **110*b* is caused to close. Accordingly, the operation of the cage 104 becomes possible. When more than two adult passengers ride in the cage chamber, the output of the detector 109A becomes "L". Then, the output of the AND gate 125 also becomes "L", and the relay 110 is not energized. Accordingly, the cage 104** cannot be operated.

In the case where more than two voices are sounded as when other passenger sounds are detected, a "two passengers" signal is generated and the cage is not allowed to operate. On the other hand, if the voice of one passenger is picked up by the microphone 123, the voice recognition unit 124 detects the voice of "one passenger", its output becomes "H", and the cage in which the passenger rides is allowed to operate.

It is assumed that, for the case where the loading capacity of the cage chamber 117 is 1000 kg., the detector 7A detects whether or not the passenger weight is less than a total weight of 90 kg or 40 kg for female passenger's and 50 kg for light male passenger's. Then, the ratio of the minimum weight to the loading capacity becomes $90/1000=0.09=9\%$. As a result, the detector 7A can measure up to this value. Therefore, the detector 7A can detect the presence of less than two passengers.

In the above-described embodiment, the detector 109A can similarly detect the number of passengers in the cage chamber 117 even if the detector measures the quantity of deflection of the rubber 118 instead of measuring the quantity of deflection of the spring 120.

Next, a modified example of the passenger detector 7 will be described with reference to FIGS. 11 and 12.

The output from the photodetector 6 is inputted as an input pulse (FIG. **12-*b*) to a wave shaper 201. When a passenger rides in the cage, the output of the wave shaper 201 is supplied to flip-flops 202 and 203. Since the D terminal input of the flip-flop 202 is always "1" (HIGH), when an input is applied to the T terminal, the output of the flip-flop 202 is inverted, causing the output on the Q terminal to become "1" (FIG. 12-*c*), which inturn is inputted to the D terminal of the flip-flop 203. Since the input of the T terminal of the flip-flop 203 is "0" (LOW) at this time, the flip-flop 203 does not perform an inverting operation. If a second passenger does not enter the cage, the terminal Q of the flip-flop 203 remains "0". Then, a driver 204 and a transistor 205 do not operate, and the relay 8 is not energized. The contact 8*a* of the relay 8 remains closed, the relay 11** is energized, and the cage is started.

On the other hand, when a second passenger subsequently enters with the first passenger into the cage, an additional input pulse (FIG. **12-*b*) is input through the wave shaper 201 to the flip-flops 202 and 203. The flip-flop 202 remains at its Q terminal output "1", but the output of the flip-flop 203 is inverted and the output on terminal Q become "1" (FIG. 12-*d*). Thus, the driver 204 is operated, the transistor 205 conducts, and the relay 8 is energized (FIG. 12-*e*). Then, the contact 8*a* is opened, the relay 11** is not energized, and the cage is not allowed to operate.

Figure 13:
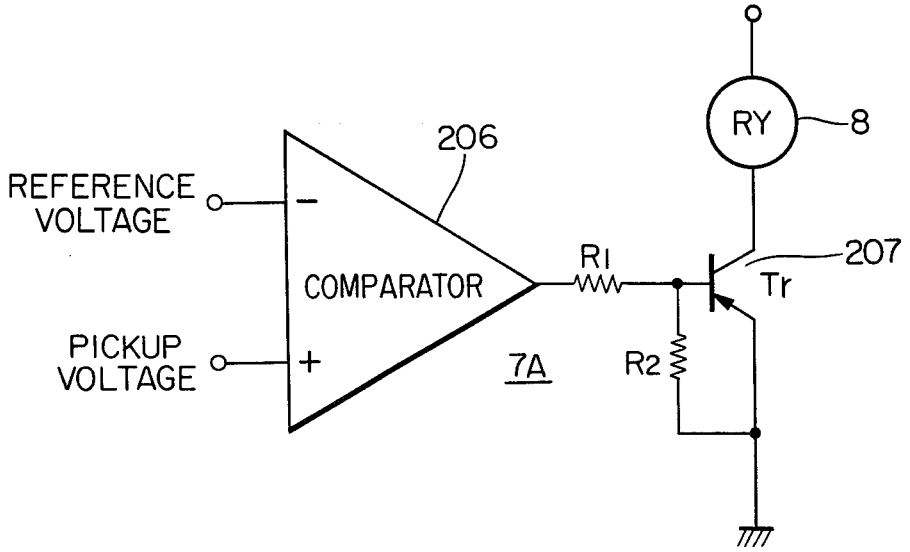
FIG. 13 is a circuit diagram showing another modified example of the passenger detector.
Figure 14:
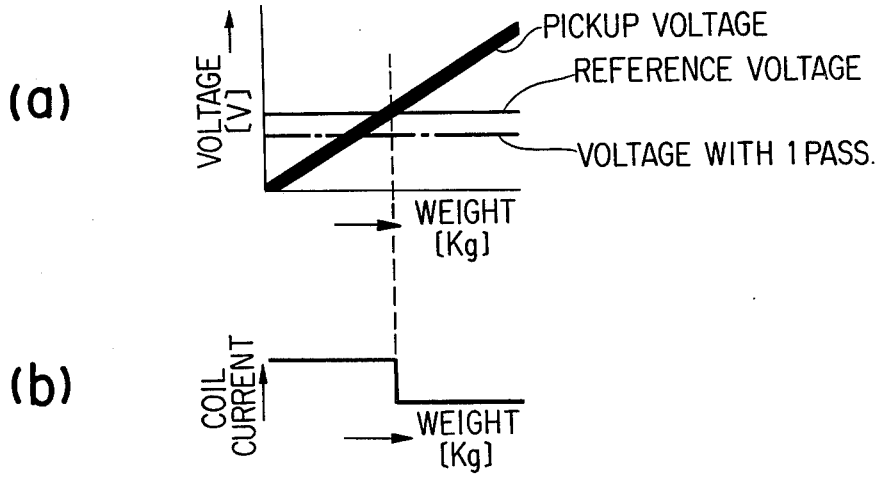
FIG. 14 is an explanatory view of the operation of the circuit in FIG. 11.

FIGS. 13 and 14 illustrate another modified example of the passenger detector 7A of the present invention.

A load signal from the load detector 19 is inputted as a pickup voltage to one terminal of a comparator 206. A reference voltage corresponding to the weight of a passenger who is slightly heavier than the weight of an average person is inputted to the other terminal of the comparator 206. Accordingly, as indicated in FIGS. **14(*a*) and 14(*b*), when the value of the pickup voltage is lower than the reference voltage, the comparator 206 produces an output. Thus, a transistor 207 is in a conductive state, and the relay 8 is energized. Then, the normally-open contact 8*b* of the relay 8 is closed, the relay 11** is energized, and the cage is allowed to operate.

On the other hand, when the pickup voltage value is larger than the reference voltage, and hence, when more than one passenger ride in the cage, the comparator 206 does not produce an output and the contact **8*b*** remains open. Accordingly, the cage is not allowed to operate.

Figure 15:
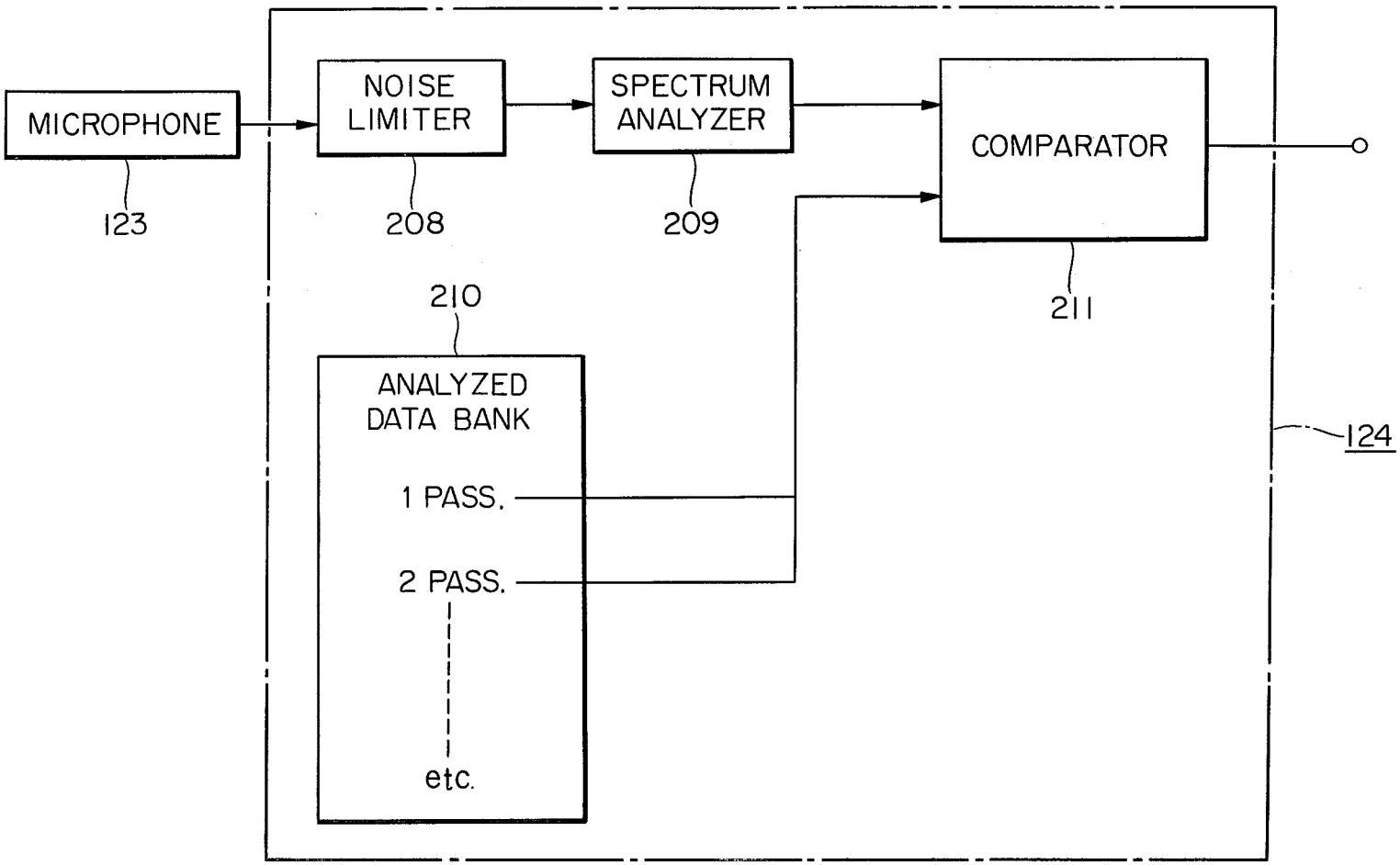
FIG. 15 is a circuit block diagram showing a modified example of a voice recognition device.

In FIG. 15, an example of the voice recognition unit 124 is shown.

A voice signal from the microphone 123 is first inputted to a noise limiter 208, and only necessary voice signals are picked up. Thereafter, the voice signal is inputted to a spectrum analyzer 209, which analyzes the voice signal waveform, and which converts the signal into a predetermined code signal. This encoded signal is inputted to one terminal of a comparator 211. Information obtained by encoding the voice signals such as "one passenger", "two passengers", . . . is inputted from a data bank 210 to the other terminal of the comparator 211. When the information from the spectrum analyzer 209 coincides with the data becoming "one passenger" of the data bank 210, the comparator 211 produces an high output "H". This signal is fed to an AND gate 125.

Figure 11:
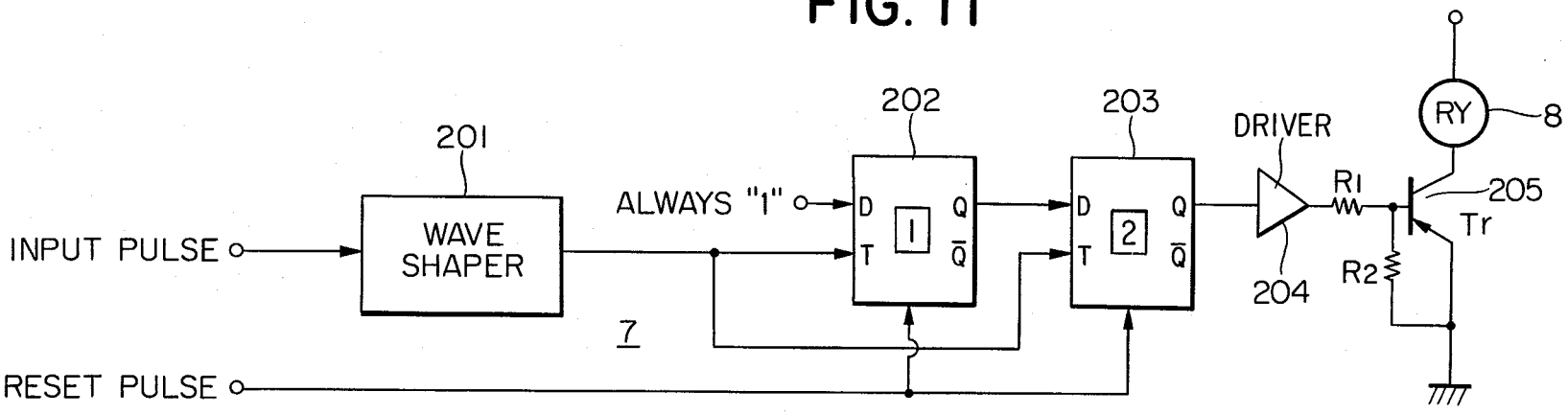
FIG. 11 is a circuit diagram showing a modified example of a passenger detector.
Figure 12:
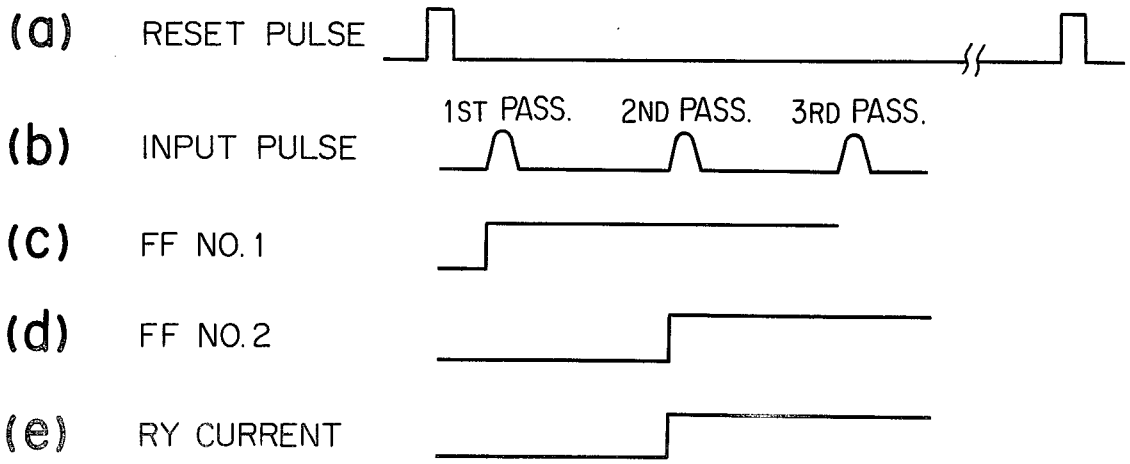
FIG. 12 is a waveform chart describing the operation of the circuit in FIG. 11.

The passenger detector shown in FIG. 11 may be applied to the passenger detector 7A in FIG. 3.

What is claimed is:

1. A crime prevention apparatus for controlling the operation of an elevator to reduce crimes in an elevator cage, comprising:

a crime prevention instructing unit automatically or manually operated at a predetermined time for commencing an operation for a crime prevention;

a passenger detector for detecting whether or not the number of passengers in the cage is one; and a start instructing unit for enabling the operation of the cage only when said passenger detector detects that the number of passengers in the cage is one and said crime prevention instructing unit instructs a crime prevention operation.

2. The crime prevention apparatus of claim 1 wherein said start instructing unit comprises a start instruction generating means for driving the cage door and generating a start instruction for starting the cage, said start instruction generating means generating a start instruction when said crime prevention instructing unit does not instruct the crime prevention operation in the case where a cage service is called and stops the operation of said start instruction generating means thereby inhibiting the production of the start instruction in the case where said crime prevention instructing unit instructs the crime prevention operation.

3. The crime prevention apparatus of claim 2 wherein said start instructing unit comprises first switching means forming a first circuit for applying a signal for obtaining a cage service as it is from said start instruction generating means when said crime prevention instructing unit does not instruct a crime prevention operation and stopping the application of the cage service signal to said start instruction generating means when said crime prevention instructing unit instructs the crime prevention operation, and second switching means forming a second circuit for preventing the application of the cage service signal to said start instruction generating means when said instructing unit instructs the operation and applying the cage service signal to said start instruction generating means when said instructing unit instructs the operation.

4. The crime prevention apparatus of claim 3 wherein said first and second circuits are connected in parallel with one another, and the parallel circuit is connected to said start instruction generating means.

5. The crime prevention apparatus of claim 3 wherein said crime prevention instructing unit comprises a relay for generating an instruction signal, and the contact of said relay forms said second switching means.

6. The crime prevention apparatus of claim 3 wherein in said second circuit a contact which operates reversely to the ON-OFF operations of said first switching means is connected in series with said second switching means.

7. The crime prevention apparatus of claim 2 wherein a signal for representing the calling of the cage service is generated by a cage calling button provided in a hall or a destination button in the cage.

8. The crime prevention apparatus of claim 1 wherein said crime prevention instructing unit performs a switching operation for automatically generating an instruction for crime prevention during the night.

9. The crime prevention apparatus of claim 1 wherein said crime prevention instructing unit comprises operation buttons provided at least one in the hall and one in the cage, and generates an instruction for crime prevention when a button is operated.

10. The crime prevention apparatus of claim 1 wherein said crime prevention instructing unit detects a passenger's voice in the elevator and generates an instruction for crime prevention.

11. The crime prevention apparatus of claim 1 wherein a detector for detecting passengers by the interruption of a light ray is used as a passenger detector.

12. The crime prevention apparatus of claim 1 wherein a detector for detecting a load in the cage by the quantity of deformation of an elastic member is used as a passenger detector.

* * * * *